United States Patent [19]

Banov et al.

[11] Patent Number: 4,479,029

[45] Date of Patent: Oct. 23, 1984

[54] BIPOLAR FLEXIBLE WATER-COOLED CABLE

[75] Inventors: Mikhail D. Banov; Anatoly I. Oshkin; Alexandr N. Chernyshev, all of Kuibyshevskol, U.S.S.R.

[73] Assignee: Toliyattinsky Politekhnichesky Institut, U.S.S.R.

[21] Appl. No.: 422,901

[22] PCT Filed: Jan. 28, 1981

[86] PCT No.: PCT/SU81/00008

§ 371 Date: Sep. 7, 1982

§ 102(e) Date: Sep. 7, 1982

[87] PCT Pub. No.: WO81/02616

PCT Pub. Date: Aug. 5, 1982

[51] Int. Cl.[3] ..... H01B 7/34

[52] U.S. Cl. ..... 174/15 WF; 174/15 C; 219/137.9

[58] Field of Search ..... 174/15 C, 15 WF; 219/137.9

[56] References Cited

U.S. PATENT DOCUMENTS

| | | | |
|---|---|---|---|
| 3,596,786 | 8/1971 | Bernard | 174/15 WF X |
| 3,801,724 | 4/1974 | Goodman | 174/15 C |
| 3,808,350 | 4/1974 | Kluge et al. | 174/15 WF |
| 3,917,898 | 11/1975 | Iketani et al. | 174/15 C |
| 4,310,718 | 1/1982 | Eng | 174/15 WF |

FOREIGN PATENT DOCUMENTS

| | | | |
|---|---|---|---|
| 1084794 | 7/1960 | Fed. Rep. of Germany | 174/15 WF |
| 2254982 | 5/1974 | Fed. Rep. of Germany | 174/15 C |
| 2500570 | 7/1975 | Fed. Rep. of Germany | 174/15 WF |

OTHER PUBLICATIONS

Welding Reference Book, Ed. by E. V. Sokolov, vol. 1.

*Primary Examiner*—Fred L. Braun
*Assistant Examiner*—Morris H. Nimmo
*Attorney, Agent, or Firm*—Lilling & Greenspan

[57] ABSTRACT

A bipolar flexible water-cooled cable includes a positive conductor and one or more return conductors. The positive conductor extends along the longitudinal axis of the cable and is placed in an insulating sheath so that a gap is provided between the positive conductor and insulating sheath for passage of a cooling agent. Return conductors are wound on the insulating sheath at an angle α, equal to 15° to 82°, to the longitudinal axis of the cable. The positive and return conductors are placed in a hose of an insulating material. The diameter $D_0$ of the return conductor and the diameter $D_1$ of the positive conductor are determined by the relationship $$D_o = \frac{D_1}{\sqrt{n}},$$

where n is the number of return conductors.

The cable is intended primarily to be used in welding to connect a power transformer with a portable welding gun.

5 Claims, 4 Drawing Figures

BIPOLAR FLEXIBLE WATER-COOLED CABLE

FIELD OF THE INVENTION

The present invention relates to electrical engineering and, more particularly, to electric cables, namely, bipolar flexible water-cooled cables.

DESCRIPTION OF THE PRIOR ART

At present, transformers are normally connected to welding guns by means of bipolar flexible water-cooled cables of the type in which the go (positive) and return conductors are placed in a common hose; they alternate in the direction of the current and are insulated from each other by a profiled rubber sheath (cf., "Welding Reference Book", ed. by S. V. Sokolov, vol. 1, Moscow, 1961, p. 368).

Cables of this type suffer from fast wear of the conductors due to electrodynamic shocks. This disadvantage is partially eliminated in a cable produced by the British "Huddon" company.

A bipolar flexible water-cooled cable, produced by Huddon, comprises go (positive) and return water-cooled conductors which are placed in a common hose, alternate in the direction of the current and are insulated from each other by a profiled sheath; the go and return conductors are stranded at a pitch of 300 mm.

In the latter type of cable, electrodynamic shocks are reduced or countered by directing current to three separate alternating conductors and by reducing the electrodynamic interaction length from 2,500 mm to 300 mm, which, in turn, is attained by stranding the conductors at a pitch of 300 mm.

However, the use of three alternating conductors in which current flows in different directions and the reduction of the length over which the conductors interact with one another do not fully eliminate electrodynamic shocks, because the go and return conductors in the Huddon cable are parallel; it must be borne in mind that electrodynamic forces grow weaker if the go and return conductors intersect. The dynamic characteristics of a cable can be improved by increasing the number of conductors, but this leads to a very complicated cable design; on the other hand, it is impossible to reduce the stranding pitch because of plastic deformation of the conductors. In the cable under review, electrodynamic shocks account for rapid wear of the conductors throughout the cable length; the wear is the strongest at points where the conductors are coupled to welding connectors. In welding connectors, the radial electrodynamic forces produce a tangential component which breaks the cable conductors in immediate proximity to the welding connector. Besides, the conductor stranding and cable assembly conditions are such that the dielectric sheath can only be 1 mm thick; abrasion, bending and heat lead to fast wear of such a thin sheath, wherefore conductors of different polarity may be shorted at any point along the cable.

The stranding of the positive and negative polarity conductors in combination with the insulating sheath and neutral conductor is a complicated process that has to be done by highly skilled operators, keeping in mind that the final stage of the stranding operation is carried out manually. The most important thing is to ensure normal stranding of the conductors. If the strand pitch is greater than 300 mm, the conductors of different polarities are brought together during the initial two days of operation, the conductors of different polarities no longer alternate, and electrodynamic shocks gain in strength. The cable starts "dancing" in the hands of the operator, a single workshift is enough to put such a cable out of operation. A strand pitch of less than 300 mm seriously affects the cooling of the conductors placed in the shaped insulating sheath, because the conductors are firmly pressed together and there is not enough space for the passage of cooling water. The resultant overheating renders the cable inoperative.

SUMMARY OF THE INVENTION

The present invention essentially aims at providing a bipolar flexible water-cooled cable design which would minimize electrodynamic shocks, while ensuring excellent electrical characteristics of the cable.

The invention provides a bipolar flexible water-cooled cable comprising a go (positive) conductor and a return conductor insulated from each other and placed in a common hose. According to the invention, the go conductor extends along the cable axis and is placed in an insulating sheath, the gap between the go conductor and sheath serving for passage of a cooling agent. At least one return conductor is wound on the insulating sheath at an angle of 15° to 82° to the longitudinal axis of the cable. The relationship between the diameter $D_o$ of the return conductor and the diameter $D_1$ of the go conductor being as follows:

$$D_o = \frac{D_1}{\sqrt{n}},$$

where n is the number of return conductors.

In order to improve the wear resistance of the cable according to the invention by ruling out friction of conductors of different polarity, it is advisable that the return conductors should be spaced from one another at a distance of about 0.15 of their diameter.

The optimum value of the angle $\alpha$ at which a predetermined number of return conductors are to be wound is derived from this formula:

$$\alpha = \arccos \frac{0.18\sqrt{n}}{K_1},$$

where $K_1$ is a coefficient which indicates the distance between the axes of the go and return conductors and is equal to:

$$K_1 = 0.83 + \frac{1}{2\sqrt{n}}.$$

It is preferable that the return conductors should be made flat so as to reduce the cross-sectional dimensions of the cable.

The latter requirement makes it necessary that the number of return conductors should be equal to three and that their width B and thickness $\delta$ should be selected so as to meet these conditions:

$$B = D_1(1.9 \cos \alpha - 0.14), \text{ and}$$

$$\delta = \frac{0.26 D_1^2}{B}.$$

The bipolar flexible water-cooled cable according to this invention features a design that accounts for considerably weaker electrodynamic shocks, as compared to conventional cables; it also features improved cooling of the go and return conductors and reduces friction between the return conductors. The foregoing advantages account for high reliability of the cable.

BRIEF DESCRIPTION OF THE DRAWINGS

A better understanding of the present invention will be had from a consideration of the following detailed description of preferred embodiments thereof, taken in conjunction with the accompanying drawings, wherein.

DETAILED DESCRIPTION OF THE INVENTION

Figure 1:
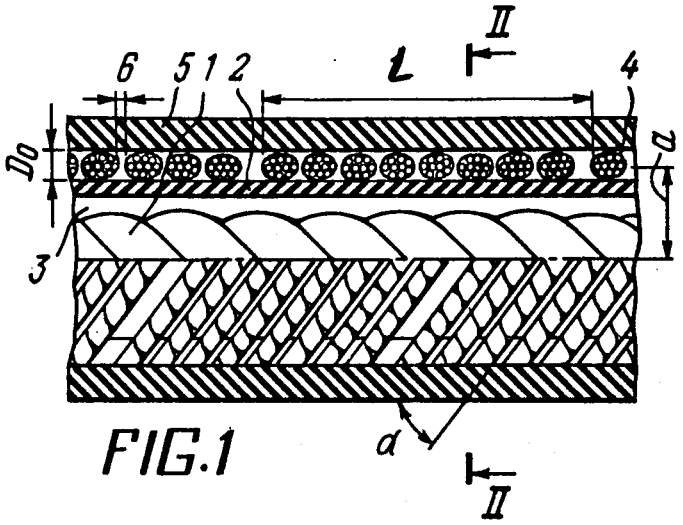
FIG. 1 is a longitudinal sectional view of a bipolar flexible water-cooled cable with return conductors of a round cross-section, in accordance with the invention.
Figure 2:
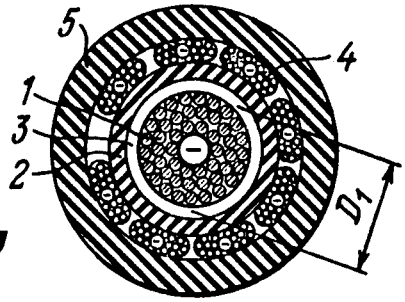
FIG. 2 is a sectional view taken on line II—II of FIG. 1.

Referring now to the accompanying drawings, the bipolar flexible water-cooled cable according to the invention comprises a go (positive) conductor 1 (FIGS. 1 and 2) extending along the longitudinal axis of the cable and placed in an insulating sheath 2. Between the go conductor 1 and sheath 2 there is a gap 3 for passage of a cooling agent, such as water. Wound on the insulating sheath 2 at an angle $\alpha$ to the longitudinal axis of the cable is at least one return conductor 4. The minimum permissible value of $\alpha$ is such that the number of return conductors 4 cannot be greater than twenty five; FIGS. 1 and 2 show a cable with eight return conductors 4.

The go conductor 1 and the return conductors 4 are placed in an elastic hose 5. In order to prevent rapid abrasion wear of the return conductors 4, a gap 6 is provided between them, which is equal to about 0.15 of their diameter.

Depending on the number of the return conductors 4, the angle $\alpha$ must be in the range of 15° to 82° so as to minimize electrodynamic shocks.

Depending on the number of the return conductors 4, an optimum value of $\alpha$ is derived from this equation:

$$\alpha = \arccos \frac{0.18\sqrt{n}}{K_1},$$

where $K_1$ is a coefficient which indicates the distance between the axes of the go conductor 1 and return conductors 4 and is equal to:

$$K_1 = 0.83 + \frac{1}{2\sqrt{n}}.$$

In order to reduce active and induced power losses, the return conductors 4 are wound at an angle $\alpha$ no more than 30°, although this somewhat affects the electrodynamic characteristics of the cable, as compared to a situation when an optimum angle of $\alpha$ is selected. The diameter $D_o$ of the return conductors 4 and the diameter $D_1$ of the go conductor 1 are related as follows:

$$D_o = \frac{D_1}{\sqrt{n}},$$

where n is the number of the return conductors 4.

Figure 3:
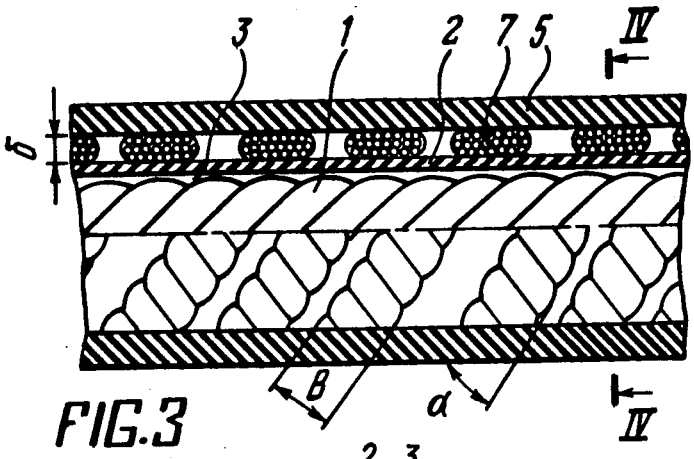
FIG. 3 is a longitudinal sectional view of a bipolar flexible water-cooled cable with three flat return conductors, in accordance with the invention.
Figure 4:
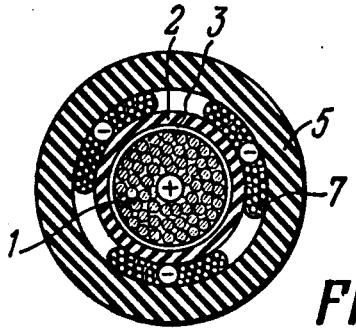
FIG. 4 is a sectional view taken on line IV—IV of FIG. 3.

Unlike the version of FIGS. 1 and 2, the bipolar flexible water-cooled cable shown in FIGS. 3 and 4 features flat return conductors 7 which have an ellipsoidal cross-section; there are three return conductors 7. The cross-section of the flat conductors 7 may also be rectangular.

The use of flat conductors 7 makes the cable design simpler, because with small values of $\alpha$ just three return conductors 7 prove to be quite sufficient. Three is also the best number, because the use of two conductors 7 or one such conductor accounts for an increased rigidity of the cable; on the other hand, the use of four or more conductors 7 makes the cable manufacture more difficult.

With three return conductors 7, the width B and thickness $\delta$ of these conductors are selected so as to satisfy these conditions:

$$B = D_1(1.9 \cos\alpha - 0.14), \text{ and}$$

$$\delta = \frac{0.26 D_1^2}{B}.$$

While the cable is in operation, current I flows through the go conductor 1 and return conductors 4 and 7 to produce electrodynamic shocks whose force F is as follows:

$$F = 2.5 \frac{I^2}{n_o \cdot n_1} \cdot \frac{L}{a} \cos\alpha \cdot 10^{-8} \text{ kg},$$

where $n_o$ is the number of the go conductors;

$n_1$ is the number of the return conductors;

L is the pitch between the turns of the conductors 4 or 7;

a is the distance between the axes of the conductors 1, 4 and 7; and $\alpha$ is the angle at which the return conductors are wound on the insulating sheath.

In the cable according to the invention, the value of F is much smaller than in conventional cables, because the conductors 1, 4 and 7 extend at an angle to each other; another reason is a reduced value L of the pitch between the turns of the conductors 4 or 7.

The cable design according to FIGS. 3 and 4 has been tested. The cable characteristics were as follows: cable length: 2,500 mm; cross-sectional area of go conductor 1 and return conductor 7: 150 mm$^2$; the value of $\alpha$: 30°; the width B of flat conductor 7: 27 mm. The electrical characteristics of the experiment were as follows: cos $\alpha$=0.992; Z=686 microhms; X=90 microhms. The cable has proved to be highly reliable. It withstood $25.10^5$ switchings on, which means its wear resistance is by one order of magnitude higher than that of the conventional cable with conductors stranded at a pitch of 300 mm.

INDUSTRIAL APPLICABILITY

The invention can be used to advantage for the transmission of heavy current of 5 to 50 kA from one object to another in situations when the relative positions of these objects change in the course of operation. The invention is applicable, for example, to electric welding where it can be used to connect a power transformer to a portable welding gun.

We claim:

1. A bipolar flexible water-cooled cable comprising a positive conductor and one or more return conductors, which are insulated from said positive conductor, said positive and return conductors being placed in a hose of an insulating material, wherein the improvement comprises the positive conductor extending along the cable axis and positioned in an insulating sheath with a gap between the positive conductor and said insulating sheath for passage of a cooling agent; and said one or more return conductors being wound on the insulating sheath at an angle=15° to 82° to the longitudinal axis of the cable, the diameter $D_o$ of the return conductor and the diameter $D_1$ of the positive conductor being related as follows:

$$D_o = \frac{D_1}{\sqrt{n}},$$

where n is the number of said return conductors.

2. A bipolar flexible water-cooled cable as claimed in claim 1, wherein the return conductors are spaced at a distance equal to about 0.15 of their diameter.

3. A bipolar flexible water-cooled cable as claimed in claims 1 or 2, wherein the value of $\alpha$ is selected so as to satisfy the following condition:

$$\alpha = \arccos \frac{0.18\sqrt{n}}{K_1},$$

where $K_1$ is a coefficient which indicates the distance between the axes of the positive and return conductors and is equal to:

$$K_1 = 0.83 + \frac{1}{2\sqrt{n}}.$$

4. A bipolar flexible water-cooled cable as claimed in claims 1 or 2 wherein the return conductors are flat.

5. A bipolar flexible water-cooled cable as claimed in claim 4, wherein there are three return conductors and the width (B) and thickness ($\delta$) of the return conductors are selected so as to meet these conditions:

$$B = D_1(1.9 \cos \alpha - 0.14), \text{ and}$$

$$\delta = \frac{0.26 D_1^2}{B}.$$

* * * * *